United States Patent [19]

Fraser

[11] 4,073,019

[45] Feb. 14, 1978

[54] LIGHTWEIGHT WATERBED ASSEMBLY

[76] Inventor: Peter Fraser, 99 Mount Auburn St., Cambridge, Mass. 02138

[21] Appl. No.: 712,550

[22] Filed: Aug. 9, 1976

[51] Int. Cl.[2] ..... A47C 27/08

[52] U.S. Cl. ..... 5/365; 5/60; 5/370

[58] Field of Search ..... 5/365, 370, 371, 60, 5/91, 349, 350; 108/150, 51

[56] References Cited

U.S. PATENT DOCUMENTS

| | | | |
|---|---|---|---|
| 3,761,974 | 10/1973 | Kuss | 5/370 |
| 3,803,647 | 4/1974 | Reswick | 5/367 |
| 3,840,921 | 10/1974 | Labianco | 5/371 |

*Primary Examiner*—Casmir A. Nunberg

*Attorney, Agent, or Firm*—Wolf, Greenfield & Sacks

[57] ABSTRACT

A lightweight comfortable waterbed assembly comprising a mattress, made of a pair of water impermeable sheets, sealed at their peripheries. An easily assembled supporting substructure of simple geometrically shaped and interlocked components, support the mattress in a non-uniformly thick configuration whereby the maximum thickness of the mattress occurs in areas in which maximum support is required.

3 Claims, 10 Drawing Figures

FIG. 1
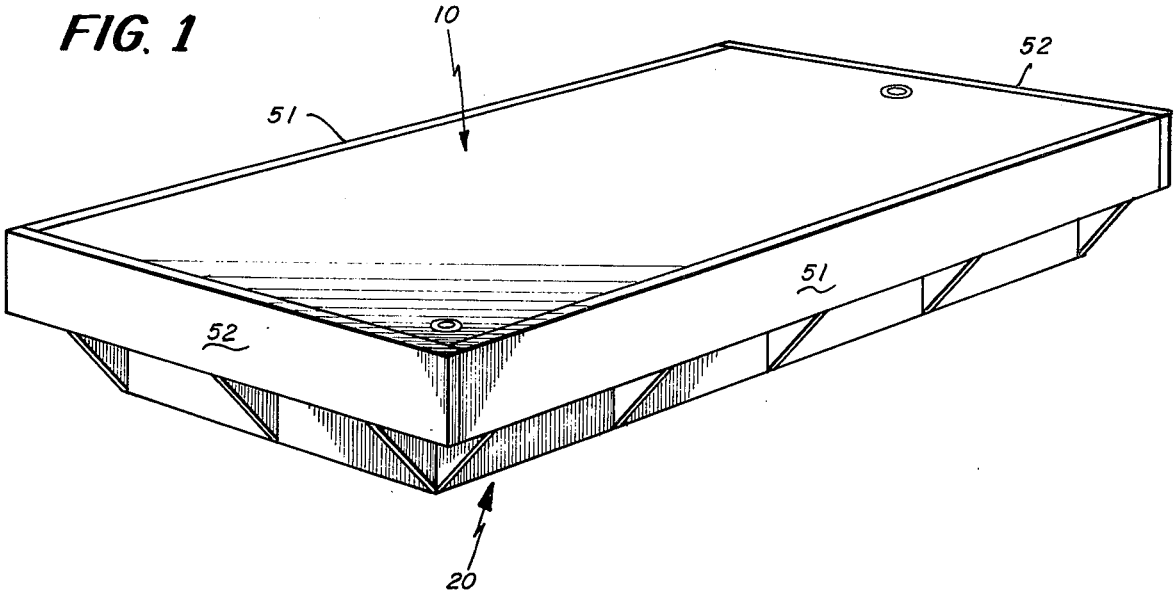
FIG. 2
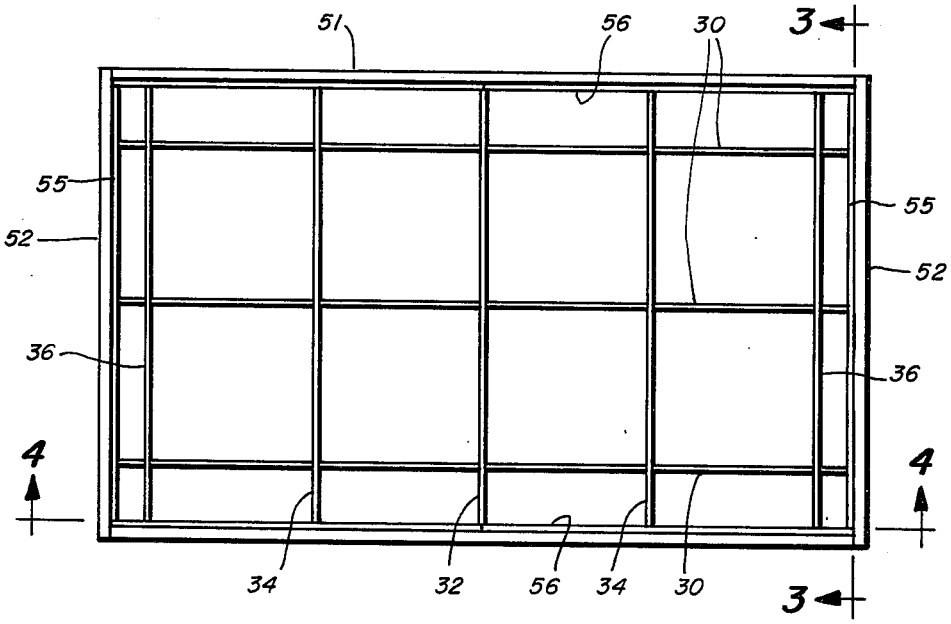
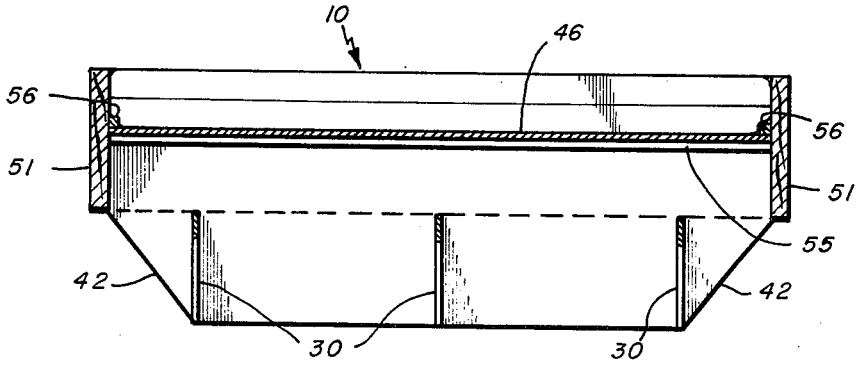
FIG. 3

FIG. 4
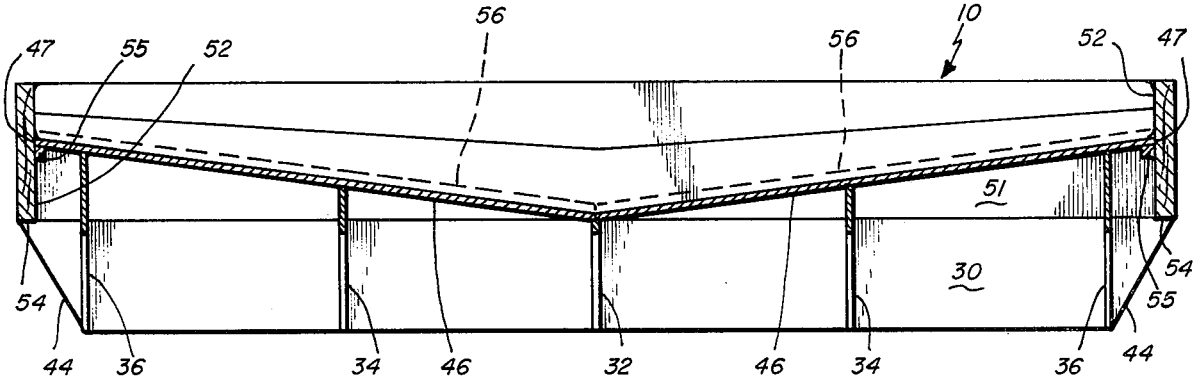
FIG. 6
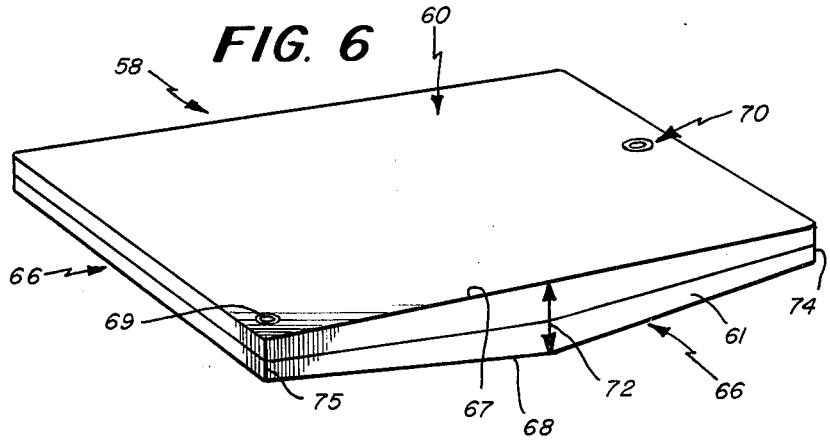
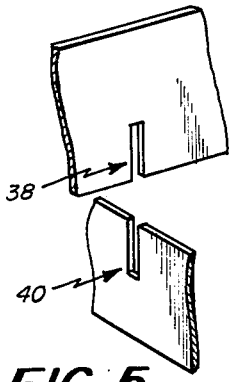
FIG. 5
FIG. 7
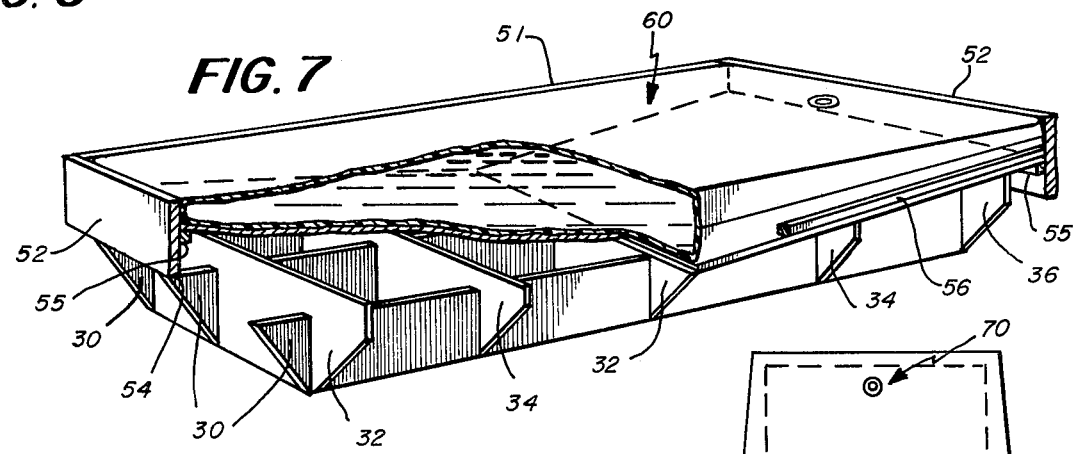
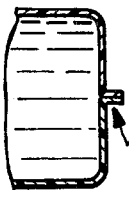
FIG. 9A
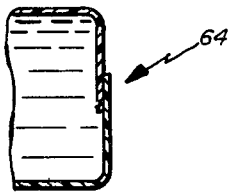
FIG. 9B
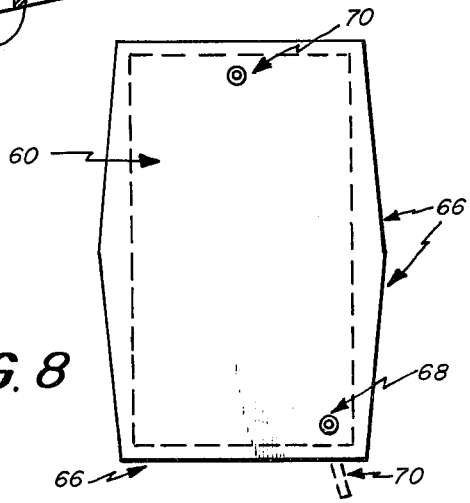
FIG. 8

LIGHTWEIGHT WATERBED ASSEMBLY

INTRODUCTION AND BACKGROUND

This invention relates to waterbed assemblies. More particularly the invention relates to a new and improved waterbed assembly, which is, when filled of considerably lighter weight than conventional waterbeds, and therefore, is safer for use on surfaces having limited load bearing capacity.

A further feature and object of this invention is to provide a substructure or supportive assembly, formed of flat pieces having only right angle corners and straight edges. Most of the pieces simply interlock with each other, and a very limited amount of hardware is required. Consequently, the substructure is easily assembled, dissassembled and stored by the user.

While waterbeds for home use are comfortable and are commonly in use today they have the undesirable feature of being extremely heavy. Therefore they may be used safely only in buildings of superior structural strength. Although some beds are easily assembled, no commerical products also solve the weight problem, are of simple design and preserve the comfort for which waterbeds are known.

While fluid supporting devices mainly intended for therapeutic purposes have been designed to have variable depth mattresses, such assemblies generally involved heavy cumbersome, non-dissassemblable substructures. These beds are complicated and expensive to make. In some cases, the supports are such that the mattresses are shallow and do not, as a consequence, provide the comfort expected of a waterbed.

One object of this invention is to provide a lightweight waterbed with a supporting structure that is simple in design and easy to assemble, store or ship.

Another object of this invention is to provide a waterbed assembly that is easily and inexpensively manufactured.

Still a further object of this invention is to provide a waterbed assembly which is as comfortable to users as conventional flat mattress waterbeds.

These and other objects and features of this invention will become clearer in the description to follow:

BRIEF FIGURE DESCRIPTION

FIG. 1 is a perspective view of a waterbed assembly constructed in accordance with this invention.

FIG. 2 is a top view of the waterbed assembly shown in FIG. 1, with the mattress supporting sheets removed to expose more fully the substructure.

FIG. 3 is a transverse, vertical cross section of the assembly shown in FIG. 1 taken along the line 3—3 of FIG. 2.

FIG. 4 is a longitudinal, vertical cross section of the assembly shown in FIG. 1, taken along the line 4—4 of FIG. 3.

FIG. 5 is a fragmentary, exposed perspective view of interconnecting vertical support member 5.

FIG. 6 is a perspective view of the mattress used in the bed shown in FIG. 1.

FIG. 7 shows a transverse vertical cross section of another embodiment of this invention in which the line of intersection between the planar mattress supporting sheets is longitudinal rather than transverse as it is in FIGS. 1–5, FIG. 8 is a top view of the mattress of this invention in flat form;

FIGS. 9A and 9B show alternate constructions of a seam detail of this invention.

DETAILED DESCRIPTION

In the embodiment shown in FIGS. 1–6, the mattress 10 is supported on a substructure 20 which includes a plurality of vertical support members 30, 32, 34 and 36. Three longitudinal vertical support members 30 are identical and are spaced parallel and at uniform distances. These members 30 form the longitudinal supports for the substructure. Vertically interlocked with and normal to the longitudinal members 30 is the central transverse vertical support member 32 which is of the same height as the longitudinal members 30 and intersects them at their midpoints. Two medial transverse support members 34 are symmetrically located on opposite sides of the central support members 32. The supports 34 interlock with the longitudinal support members 30 at a distance from their centers of somewhat less than a quarter the length of the latter. Two symmetrically located external transverse support members 36 also intersect the support members 30, near their ends. The support members 36 interlock with support members 30 close to their ends.

The heights of the support members 34 and 36 are chosen so that their top edges lie in planes extending from the top edge of support members 31 and inclined at an angle of about 15° from the horizontal, as shown in FIG. 4.

The transverse support members 32, 34, and 36 are each slotted with slots 38 in their lower edges at positions to intersect with the longitudinal members 30 which also have slots 40 in their upper edges at corresponding positions. These have total depths sufficient to permit the bottom edges of all these members to be coplanar when rigidly interlocked with each other in the lattice pattern shown in FIG. 2. The slots are of depths slightly greater than half the height of the transverse members.

The eight support members described may be made of plywood or other suitable material by a series of straight cuts, including end cuts 42, 44, as shown in FIG. 2.

A pair of rigid mattress supporting planar sheets 46 made preferably of a sheet of plywood, each lie with one edge resting on the central transverse vertical support member 32. Each of these planar sheets also rests in an inclined attitude on the transverse support members 34, 36 on one side of the central members 32. The two planar sheets 46 form a V-shaped surface with an obtuse angle of about 150°, in a lengthwise direction, as shown in FIG. 3. The outer end edges 47 of sheets 46 terminate short of the ends of the longitudinal supports 30 while the outer edges 48 are over the ends of the members 32, 34, and 36.

A rectangular frame 50 is formed of side members 51 and end members 52 suitably connected at adjacent ends by brackets or the like in a conventional fashion. The members forming the frame are preferably formed of wood beams having a cross section in the order of 2 × 10. inches. The frame is dimensioned so that the lower edge of end members 52 rest upon and are supported by the ends of members 30 as illustrated at 54. A pair of supporting strips 55 are secured lengthwise of each end member 52 intermediate its upper and lower edges. These strips 55 are positioned below and serve to support the end edges 47 of the sheets 46. The rigidly interconnected side members 51 are also provided with strips 56 that are secured intermediate the upper and lower edges. These strips extend at angles to the length of the members 51 and are positioned to engage the upper side edges of the adjacent sheets 46 to support the frame 50.

The substructure described involves only simply cut wooden pieces which can be assembled in a simple interlocking fashion without hardware for any of the components except the frame 50. The hardware for these components may comprise screws or simple brackets.

The mattress 58 best illustrated in FIG. 6 substantially fills a volume defined by the frame 50, sheets 46 and the plane extending through the upper edges of the members forming frame 50. The mattress 58 contains about 35% less water than a standard rectangular mattress having a uniform depth equal to the maximum depth of mattress 58.

The mattress 58 is formed of an upper fluid impermeable sheet 60 and a lower fluid impermeable sheet 61. These two flexible fluid impermeable sheets may be made of any suitable plastic material preferably adapted to be thermal plastically heat sealed together. The peripheries of these two sheets may be heat sealed with a butt seam or lap seamed along the peripheral line 66 as shown in FIGS. 9A at 62 and 9B at 64, respectively. The seam line 66 is normally intermediate the upper edge 67 of the mattress and the lower edge 68. A suitable top filler valve 69 and air bleeder valve 70 may be integrally formed in the top sheet 60. The seam 66 is positioned to extend about the side wall of the mattress, which when positioned on the support is adjacent the members forming the frame 50 intermediate the upper and lower edges of the frame. As illustrated in FIG. 6, the filled mattress has a dimension at its transverse center, illustrated by the dotted arrow 72 that is greater than the height of the matress at its ends.

In order to attain a shape as illustrated in FIG. 6, the sheets 60 must be initially cut with their side edges bowed or angled from the corners 74 and 75, on each side, to the center line 72. The bowing on each sheet 60 must be one half the difference in the effective height of the mattress at the center over the effective height at the end edges.

The thickness of the mattress, as illustrated, is greatest along the line transverse of the waterbed assembly. Since the greatest weight on a mattress during normal usage is along this center transverse section, the waterbed will function in essentially the same fashion as conventional waterbeds of uniform thickness without sacrificing any of the comforts of such waterbed mattresses.

In an alternative embodiment of this invention the thickest section of the mattress may be arranged longitudinally of the waterbed rather than transversely. This arrangement is essentially illustrated in FIG. 7. In this embodiment, as in the preferred form, the thickest section of the waterbed mattress is designed to underly the section in which the greatest weight of the person using the bed is concentrated. In this embodiment the greatest thickness of the mattress would normally extend under a person lying in the center of the bed.

I claim:

1. A lightweight waterbed assembly comprising a fluid filled mattress and a substructure therefore, said substructure including, a pair of planar sheets for engaging and supporting the bottom of said mattress, a supporting frame comprising a lattice of interlocked members having upper edges positioned to support and engage said planar sheets in planes at an obtuse angle to one another, a retaining frame having sides and ends defining a rectangular wall, means supporting said retaining frame on said supporting frame with edges of said retaining frame extending above and other edges thereof extending at least partially below the outer edges of said planar sheets to define a cavity to receive said mattress with said cavity open at the top and with a non-uniformly deep bottom so that the maximum thickness of the mattress occurs in areas where maximum body support is required, said mattress being fabricated of upper and lower water impervious sheets sealed at their peripheries, each of said water impervious sheets having a width which is greater intermediate the ends than at the ends, said lower water impervious sheet conformed to the surfaces defined by said planar sheets and the walls of said retaining frame, said lattice of interlocked members include two sets of flat elongated members with each elongated member having parallel longitudinal edges and a plurality of slots in one of said edges, said sets positioned normal to one another with one set above the other and with said slots of one set aligned and interlocked with the slots of the other set.

2. A lightweight waterbed as set forth in claim 1 wherein said retaining frame rests upon and engages opposite ends of one set of said elongated members.

3. A lightweight waterbed as set forth in claim 2 wherein at least the elongated members of one set have a trapezoidal shape.

* * * * *